United States Patent [19]

Riley

[11] Patent Number: 4,920,647

[45] Date of Patent: May 1, 1990

[54] DEVICES FOR THE REMOVAL OF CAULK FROM EXISTING CAULKED JOINTS

[76] Inventor: Michael D. Riley, 1431 W. 183rd St., Homewood, Ill. 60430

[21] Appl. No.: 329,273

[22] Filed: Jun. 19, 1989

Related U.S. Application Data

[63] Continuation-in-part of Ser. No. 42,042, Apr. 24, 1987, abandoned.

[51] Int. Cl.[5] ..... B26B 3/00

[52] U.S. Cl. ..... 30/169; 15/236.1

[58] Field of Search ..... 30/169, 171, 172; 15/236.1; 7/100

[56] References Cited

U.S. PATENT DOCUMENTS 925,259 6/1909 Ziegler ..... 30/169 X 4,690,724 9/1987 Outlaw ..... 30/169 X

*Primary Examiner*—Douglas D. Watts

*Attorney, Agent, or Firm*—Charles F. Meroni, Jr.

[57] ABSTRACT

A caulk bead removal tool for removing caulk and beading from a groove between spaced side-by-side concrete building panels and includes a handle. A U-shaped mounting bracket is mounted at one end of the handle. Fasteners secure a center bracket leg of the bracket to one end of the handle, and the bracket has a pair of parallel bracket legs extending from opposite ends of the center bracket leg in a longitudinal direction along a longitudinal axis of the handle but away from the handle. A pair of relatively flat tool steel cutting blades. Fasteners secure the blades to the parallel bracket legs. Each of the blades has four bevel cut edges and four right angle corners where said bevel cut edges meet, with the four bevel cut edges being arranged in two sets with the edges in each set being disposed in parallel relation. The blades having their bevel cut sides mounted on the parallel bracket legs in such a way that one of said blades has its bevel cut side secured in face to face relation to the associated bracket leg and the other of the blades has its flat back side secured in abutment with an outside face of the associated parallel bracket leg.

20 Claims, 4 Drawing Sheets

FIG. 6
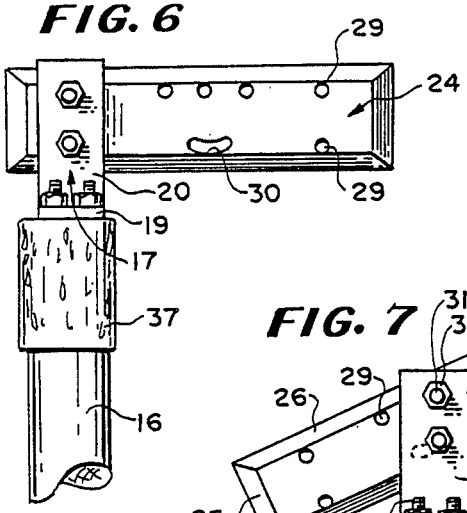
FIG. 7
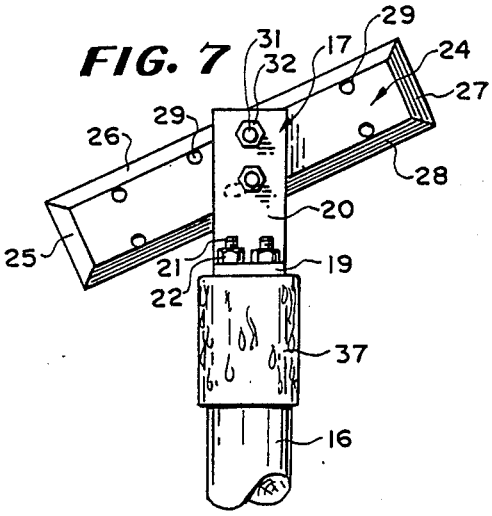
FIG. 8
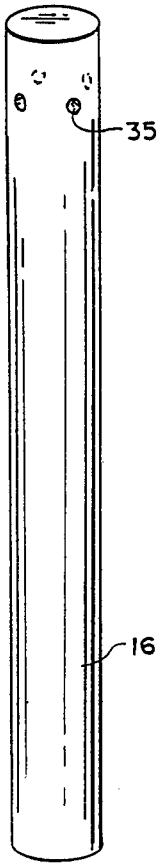
FIG. 9
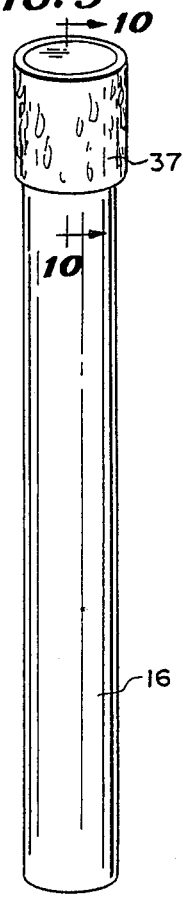
FIG. 10
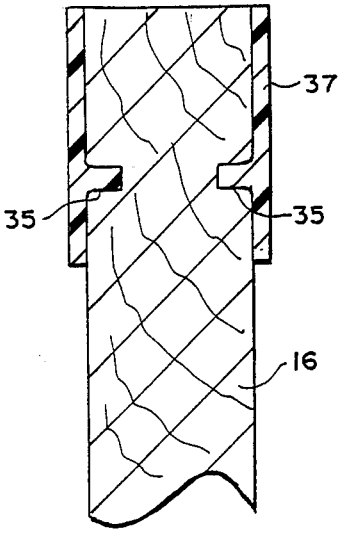
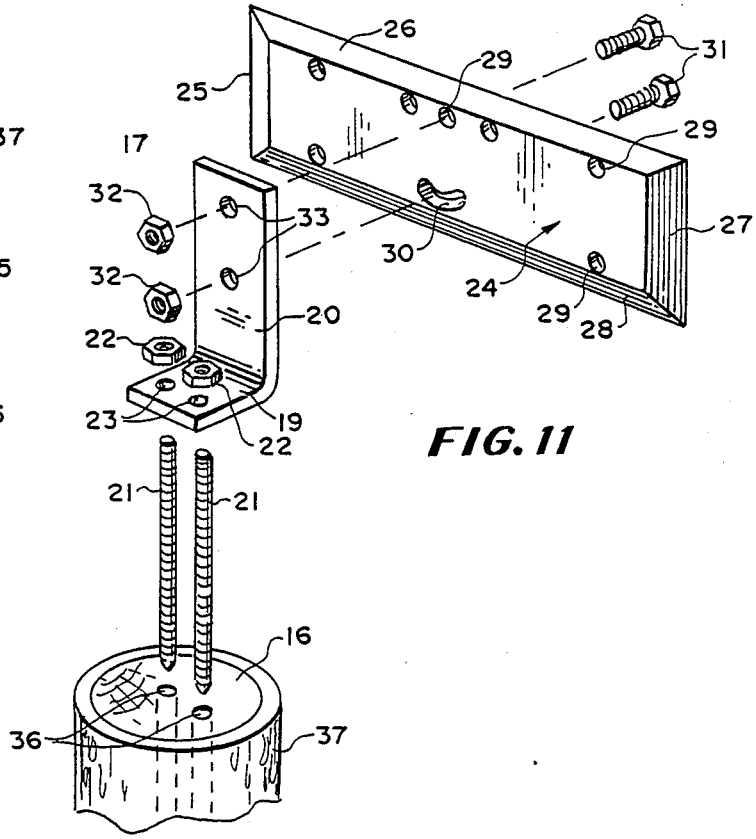
FIG. 11

FIG. 12
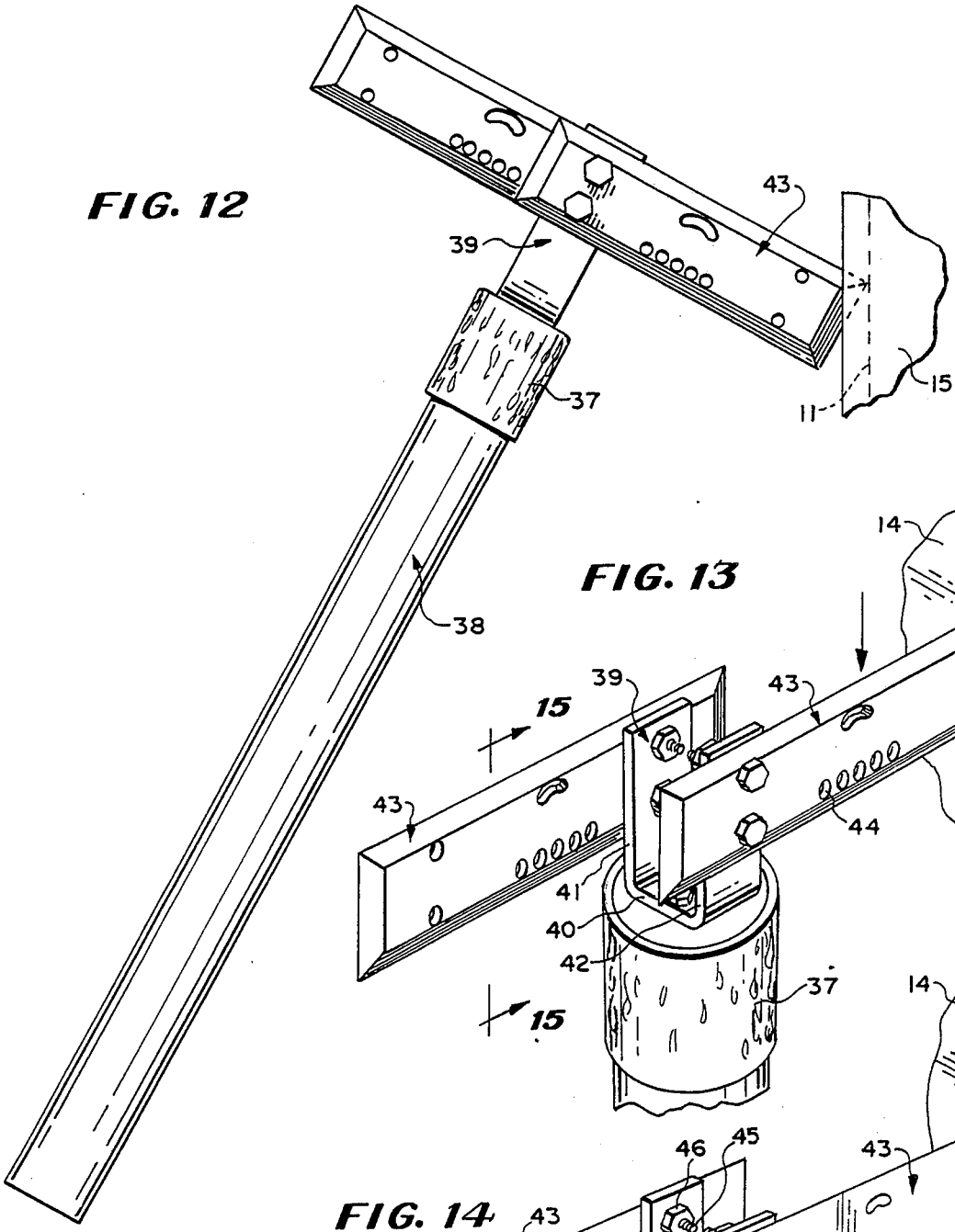
FIG. 13
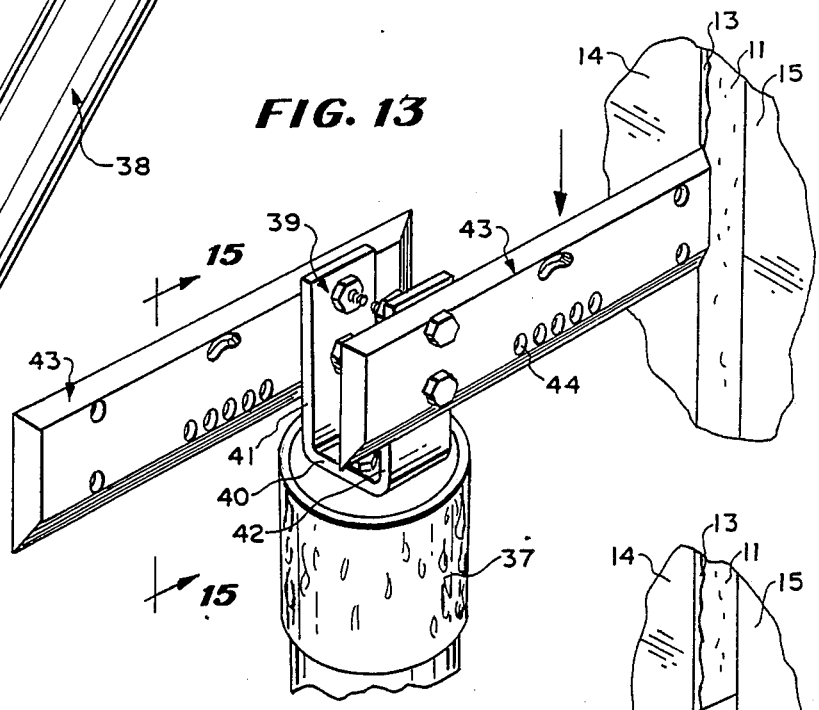
FIG. 14
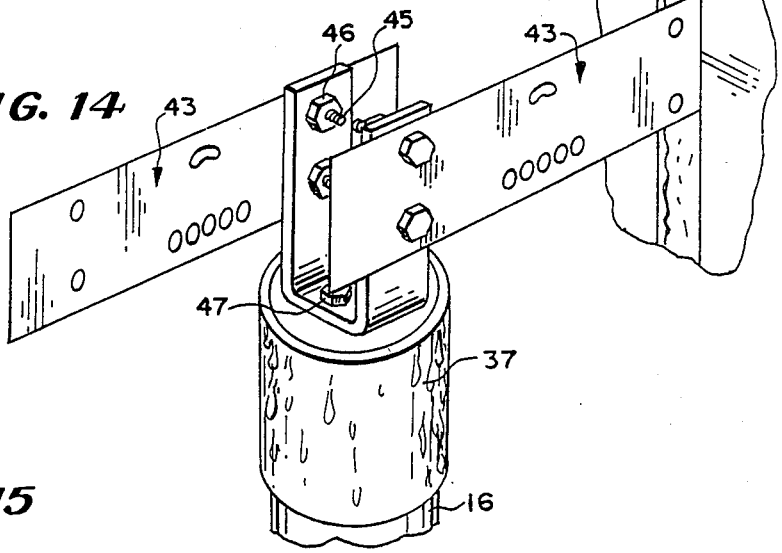
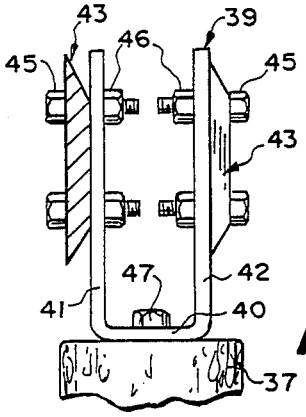
FIG. 15

DEVICES FOR THE REMOVAL OF CAULK FROM EXISTING CAULKED JOINTS

This application is a continuation-in-part of U.S. patent application No. 07/042,042 filed Apr. 24, 1987 and now abandoned.

BACKGROUND OF THE INVENTION

1. Field of the Invention

The invention relates to caulk-bead removal tools for removing caulk and beading from grooves between spaced side-by-side concrete building panels which may be used either in a vertical wall structure or in a patio floor structure. The present invention also relates to a method of manufacturing the caulk-bead removal tools.

In the past, caulk-bead removal tools commonly used in industry in the U.S. have been generally utility knives. These knives are generally about six inches long, and most of the length of the knife is comprised of the handle and a relatively short blade is mounted on an end of the handle. When a workman is called upon to remove the caulk-bead joint between a pair of side-by-side floor positioned panels or in a pair of side-by-side upright wall panels such as are used in an upright wall, the workman will cause the knife to be run along each edge of the panel to sever the bond between the caulk-bead joint with the spaced opposed edges of the panels. This job is a rather laborious and time-consuming job and workmen are union workmen and are commonly paid $31 per hour plus benefits for this type of work. It will further be appreciated that many buildings and patios are now being designed by architects so as to employ caulk-bead joints between side-by-side panels as there is a large amount of repair that periodically must be done to maintain these joints in a fluid tight condition. If the caulk-bead joint should fail, water may seep into the building and/or into the basement, or where the side-by-side panels are positioned in a patio floor, water may seep through the joint beneath the panels and in the northern areas of the U.S.A. where freezing and thawing is common, the panels may be caused to be displaced from a pre-set position, causing the panels to be unevenly related relative to one another thereby posing a safety hazard to persons that may be walking on the patio after it has become damaged, as described.

For the purpose of evaluating the prior art, a search has also been made in the U.S. Patent Office and as a result of this search, the searcher uncovered the following U.S. patents:

| PATENTEE | ISSUE DATE | U.S. PAT. No. |
|---|---|---|
| W. H. Hauver | 4/9/07 | 849,681 |
| S. F. Wright | 3/5/12 | 1,019,399 |
| C. Habart | 11/9/21 | 1,520,711 |
| N. E. Beck | 7/12/32 | 1,955,218 |
| A. C. Ferguson | 9/18/50 | 2,662,287 |
| William J. Eubank | 6/5/79 | 4,156,966 |
| K. G. Harrison | 6/30/64 | 3,138,867 |
| E. Alfred Olkkola | 7/13/82 | 4,338,718 |

From a review of the foregoing patents it is not believed that any of these patents are particularly pertinent to the inventions herein disclosed.

SUMMARY OF THE INVENTION

The present invention includes the provision of a caulk-bead removal tool for removing caulk and beading from a groove between spaced side-by-side concrete building panels comprising a handle, an L-shaped mounting bracket at one end of the handle, means securing one leg of the mounting bracket to the handle, a second bracket leg extending axially away from the one leg in a direction generally along a horizontal axis of the handle, a relatively flat, parallel edged tool steel cutting blade, the blade having four beveled cut edges, and four right angle corners where said bevel cut edged meet, the four bevel cut edges being arranged in two sets with the sets being at right angles to one another, blade attachment means for attaching the cutting blade to the second bracket leg, and spaced mounting holes in the blade for cooperation with the attachment means.

Referring more particularly to other features of my invention, I have another caulk-beading removal tool for removing caulk and beading from-a groove between spaced side-by-side concrete building panels. The tool comprises a handle, a U-shaped mounting bracket at one end of the handle, means securing a center bracket leg of the bracket to one end of the handle, the bracket having a pair of parallel bracket legs extending from opposite ends of the center bracket leg in a longitudinal direction along a longitudinal axis of the handle but away from the handle, a pair of relatively flat, parallel edged, tool steel cutting blades, means securing the blades to the parallel bracket legs, each of the blades having four bevels cut edges, the four bevel cut edges being arranged in two sets of parallel edges, the blades having their bevel cut sides mounted on the parallel bracket legs in such a way that one of the blades has its bevel cut side secured in face to face relation to the associated bracket leg and with another of the blades having its flat back side secured in abutment with an outside face of the associated parallel bracket leg.

In the one preferred embodiment of my invention, each blade is mounted at opposite sides of the center bracket leg on parallel bracket legs.

Other features of my invention concern a cutting blade for cutting caulk and beading from a caulked joint comprising a flat piece of spring or tool steel having four edges arranged in parallel sets, the edges being arranged and providing four right angle corners at the four corners of the cutting blade, each of the edges being beveled to sharpen the cutting action of the blade, and the blade having a mounting means for co-action with fasteners for attaching the blade to a hand held blade carrier.

Yet other features of my invention concern a new and improved method for removing caulk and beading from a caulked joint extending between a pair of spaced edgewise opposed paensl comprising the steps of inserting a beveled edged blade between one panel edge and the caulk and beading constituting the joint with the bevel being positioned away from the panel edge except at a point of contact at a tip end of the beveled edge and with a flat blade face being positioned for running contact with the panel edge, running the thus positioned beveled edge along the joint to free the caulk and beading along one panel edge, removing the beveled blade, rotating it 180° and running another beveled edge at an opposite edge of the blade along another panel edge at an opposite side of the joint to free the caulk and beading so that the caulk and beading can be stripped from between the spaced opposed panels.

According to still other features of my invention, the handle is comprised of a hard wood, a tool having a protective fiberglas epoxy sleeve affixed to the wooden handle at the end where the mounting bracket is attached.

Still further features of my invention concern a new and improved caulk-beading removal tool for cutting caulk and beading from a caulked joint utilizing a spring steel cutting blade having four edges arranged in parallel sets, the edges being arranged in providing four right angle corners at the four corners of the cutting blade, each of the edges being beveled to sharpen the cutting action of the blade, and the blade having a mounting means for co-action with fasteners for attaching a blade to a hand held blade carrier, the blade preferably having a thickness of 0.025"

Various other features and advantages will be apparent by reference to the following description of the preferred embodiment, from the drawings, and from the claims.

BRIEF DESCRIPTION OF THE DRAWINGS

FIG. 6 is an enlarged fragmentary side view of the tool illustrated in FIG. 1 only showing the blade mounted on the tool at one of its ends;

FIG. 7 is an enlarged fragmentary view of the tool similar to FIG. 6 only illustrating the blade mounted in an inclined position;

FIGS. 8–11 are a series of views showing the method of manufacturing the caulk-bead removal tool as shown in FIG. 1.

More specifically, FIG. 8 is a perspective view of the tool handle;

FIG. 9 is a perspective view the handle having a cuff formed at one end;

FIG. 10 is an enlarged fragmentary cross sectional view taken on the lines 10—10 looking in the direction indicated by the arrows as seen in FIG. 9;

FIG. 11 is an exploded view of the tool shown in FIG. 1;

FIG. 12 is an enlarged side view of the tool similar to the tool shown in FIG. 1 only illustrating a modified form;

FIG. 13 is an enlarged fragmentary perspective view of the modified tool shown in FIG. 12 illustrating the way in which the tool can be used to release caulk and beading from a wall joint;

FIG. 14 is an enlarged fragmentary perspective view of the tool shown in FIG. 13 only illustrating how the tool can be rotated 180° enabling the other blade used to release the caulk and bead from the opposite side of the joint;

FIG. 15 is an enlarged fragmentary edge view partially in section as seen on the line 15—15 looking in the direction indicated by the arrows as shown in FIG. 13;

Figure 1:
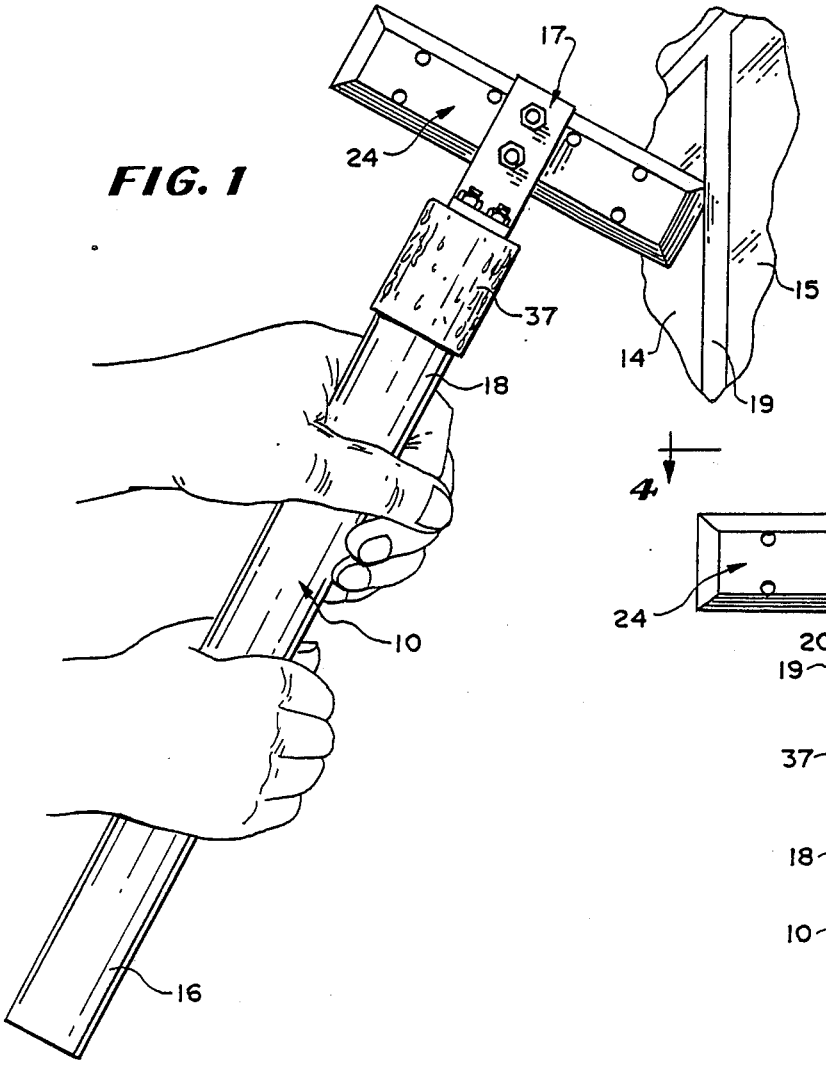
FIG. 1 is a perspective view of a caulk-bead removal tool embodying the invention illustrating its manner of use.

Before describing a preferred embodiment of the invention in detail, it is to be understood that the invention is not limited in its application to the details of construction and to the particular arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENTS

Figure 4:
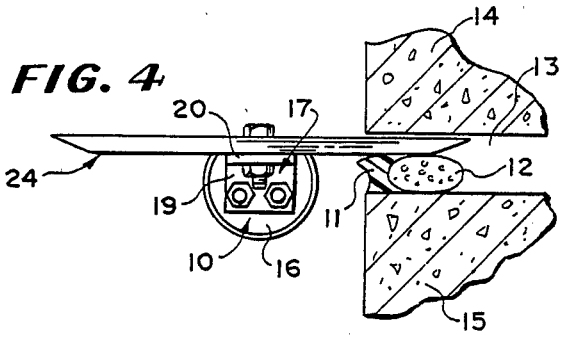
FIG. 4 is a top plan view of the tool shown in FIG. 1 illustrating how the tool is applied into a caulk joint for releasing the caulk and bead at one side of the joint.
Figure 5:
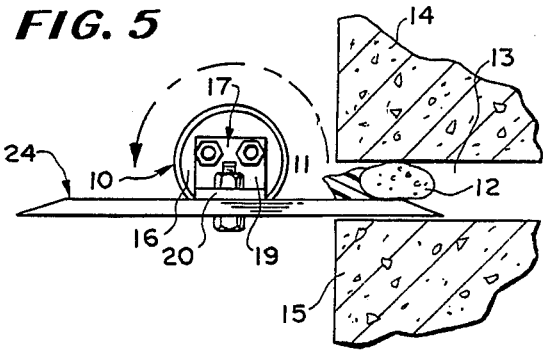
FIG. 5 is a top plan view of the tool shown in FIG. 4 (only turned over 180°) and illustrating the way in which the tool can be used to release the caulk and bead at the opposite side of the caulk joint.

The reference numeral 10 indicates generally a caulk beading removal tool for removing caulk 11 and beading 12 from a groove 12 (FIGS. 4 and 5) located between spaced side-by-side concrete building panels 14 and 15. These panels may be in an upright wall structure and the tool 10 is particularly suited for severing the old caulk and beading from opposite opposed edges of the building panels 14 and 15 so that the caulk and beading can be stripped and then replaced with new beading and caulk as illustrated in FIGS. 4 and 5.

The caulk used in the joints or groove 12 does not adhere to the bead andonly adheres to the side edges of the exposed aggregate building panels. The panels are mounted in side-by-side relation leaving a gap between them, and this is where the bead or rod and the caulk is inserted. The caulk provides a seal to prevent moisture from going beneath the panels or through the wall. If the caulk, rod or bead is used on a floor surace between panels, the caulk serves to prevent moisture from going beneath the panels, freezing, and then causing the panels to heave. In the building construction, the caulk, bead or rod serve to prevent moisture from entering into the building at the area of the joint located between the panels. Where deep joints are being sealed, it is here that backer-rods are used to control the depth of the groove.

Figure 3:
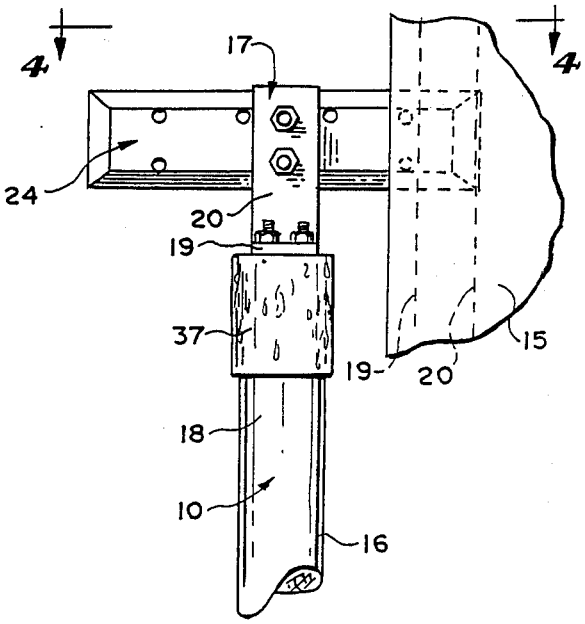
FIG. 3 is an enlarged fragmentary side view of the tool shown in FIG. 1 and showing how the tool is used to release caulking and bead from a panel joint.

The tool 10 further includes the handle 16 which is preferably manufactured from a hard wood such as ash. An L-shaped mounting bracket 17 is mounted on an upper handle end 18 on the handle 16 (FIG. 3). A pair of bracket legs 19 and 20 are provided on the bracket 17. Fasteners including threaded screws 21 and nuts 22 are provided for securing the bracket leg 19 to the adjacent end 18 of the handle. The threaded screws 21 are threaded through holes 23 in the bracket leg 19 into the end 18 of the handle 16.

In order to mount the mounting bracket 17 upon the handle 16 the threaded screws 21—21, are embedded in one end of the handle 16 as shown in FIG. 11. The bracket leg 19 is then engaged over the threaded screws 21—21 and nuts 22 are threaded onto the screws 21—21 after the threaded screws are engaged in bracket holes 23—23 thus enabling the L-shaped mounting bracket 17 to be fixedly positioned on the end of the handle as shown in FIGS. 6 and 7.

Figure 2:
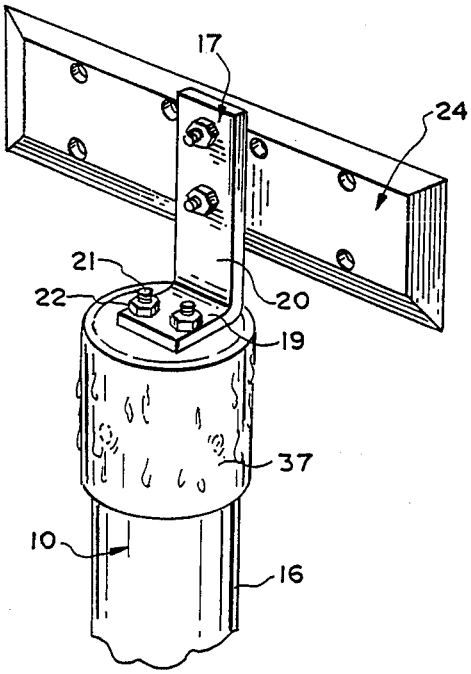
FIG. 2 is an enlarged perspective view of the tool shown in FIG. 1.

A relatively flat, parallel edged tool steel cutting blade 24 is provided for assembly with the mounting bracket 17. This blade 24 has certain preferred structural characteristics in that it is most desirable to make it of a hardened tool steel having a width of approximately 1½, a length of 5½", and a thickness of 0.080". As it will be seen, the tool blade 24 has four beveled cutting edges, 25, 26, 27, and 28 (FIG. 7) with the edges 25 and 27 being parallel to one another and with the adjacent edges 26 and 28 also being parallel to one another. The two sets of parallel edges are at right angles to one another, also. In order to mount the blade 24 on the mounting bracket 17, the blade is provided with different types of mounting holes so that the blade can either be mounted in right angular relation with the respect to the longer leg 20 of the mounting bracket 17 or it can be mounted in an inclined manner as it is shown in FIGS. 7 and 11. Still further, the mounting holes 29 are so positioned that the blade 24 can be mounted on the mounting bracket 17 so that the connection will occur at either end of the mounting blade as is shown in FIG. 6 where the blade 24 is mounted at one end on the mounting bracket 17. In order to mount the blade 24 on the bracket 17, I have found that it is desirable to provide a pair of spaced mounting holes 29—29 in the blade. Cooperable with the mounting holes 33 are threaded bolts 31—31 and threaded nuts 32—32 cooperable with holes 33 in the longer leg 20 of the mounting bracket 17 so that these components can be assembled as they are seen in FIG. 11 where the components are illustrated in exploded relation. When the components, including the bolts 31 and the nuts 32 are assembled with the holes 29 and 30 in the blade 24 and with the holes 33—33 in the longer leg 20 of the bracket 17, then the components will appear to be in assembled relation as shown in FIG. 2. As mentioned before, the blade can also be mounted from either end using the mounting holes 28—28 disposed at either end as shown in FIG. 6 or the blade 24 can be mounted in an inclined position using the holes 29 and the elongated slot 30 so that the blade will then be secured to the handle 16 in an inclined position as shown in FIG. 7.

According to other features of my invention, I have provided a new method for manufacturing a caulk beading removal tool 10, and the steps of manufacture are generally shown in FIGS. 8–11, inclusive. Initially, a wooden ash handle 16 is drilled at four circumferentially spaced intervals to provide holes 35 (FIG. 8). Also holes 36—36 (FIG. 11) are drilled generally axially into the end of the handle 16. The handle may also preferably be provided with a protective fiberglas epoxy cuff or sleeve 37 either before or after the holes 36 are drilled. This cuff can be made from a suitable compound comprising fiberglas and epoxy and excellent results can be obtained by using a commercially available product sold under the tradename "Sonolastic" (a trademark of Rexnord Chemical Products, Inc.) NI 1. "Sonolastic" NI 1 is a one component urethane nonsag (gun) grade sealant designed for a wide range of sealing and caulking applications in active exterior joints. "Sonolastic" NI 1 requires no mixing, is self-priming, and with appropriate surface preparation, it can bond to many materials such as concrete and masonry, aluminum, and wood without a primer. "Sonolastic" NP 1, after it has cured produces a flexible long-lasting joint with extraordinary adhesion, cohesion, and elasticity that resists deterioration caused by weather, stress, movement, water and many chemicals. "Sonolastic" NP 1 complies with Federal Specification TT-S-00230C, Type II, Class A; ASTM C-920, Type S, Grade NS, Class 25, use NT, M, and A. "Sonolastic" NP 1 is used to provide a positive seal for active joints. Among the many and varied applications for new construction and remedial work are:

Expansion wall joints
Curtain wall construction
Panel walls
Precast units
Aluminum/wood window frames.

Typical applications include exterior perimeter sealing of curtain wall panel, caulking and sealing fascia, parapets and other structural components. Its use is indicated wherever a high performance one component sealant is dictated. "Sonolastic" NP 1 is a gun grade low modulus sealant, which will give maximum performance if joints are properly placed and designed and if joint surfaces are structurally sound and clean. Suggested specification: the following short form guide specification is provided for the convenience of the specification writer and user. It covers the general procedure necessary for proper installation of "Sonolastic" NP 1 Sealant. Scope: furnish and install sealant as specified. All joints requiring sealant must be inspected by the contractor. It is the responsibility of the applicator to install the sealant in a manner which insures the optimum performance of materials used. Materials: sealant material shall be 100% urethane base "Sonolastic" NP 1 as manufactured by Sonneborn-Rexnord. Colors are to be selected by owner/architect. Material shall comply with Federal Specification TT-S-00230C, Type II, Class A; ASTM C-920, Type S, Grade NS, Class 25, Use NT, M, A.

Backup material must be used to control the depth of sealant and shall be Sonofoam closed-cell polyethylene Backer-Rod as supplied by Sonneborn-Rexnord. Material shall be stored in strict accordance with the manufacturer's instructions. Preparation: joint surfaces must be structurally sound, dry, clean, free of dirt, moisture, loose particles, oil, grease, asphalt, tar, paint, wax, rust, release agents, etc. Sonofoam: Backer-Rod shall be installed so as to maintain a suitable width to depth ratio as recommended by the manufacturer. Minimum joint width shall be ¼". Minimum joint depth shall be ¼". Priming: for water immersion conditions, priming is required. Sealant application: application shall be by cartridge-type gun, bulkloading gun or air pressure equipment.

In the practice of my method, as shown in FIGS. 8–11, it will be seen how the tool can be formed. With reference to FIG. 13, it will be seen how the blades 43 can be used to sever the caulk and bending first from one side of the joint as shown in FIG. 13 and then at an opposite side of the joint as shown in FIG. 14. The tool is shown as having a pair of blades and one of the blades is using for freeing the caulked joint at one side as shown in FIG. 13 and then the opposite blade is used to free the caulk beading along the joint as shown in FIG. 15. In both cases, the tip end or beveled edge is worked between the panel edge and the caulk and beading and then the beveled edge is used by running the edge between the caulk and beading and the panel edge to free first one side of the caulk and beading from one panel edge and then for feeding an opposite side of the caulk and beading from the opposite panel edge. Referring to FIG. 1, it can be seen there how a corner of the blade 24 is used to form an opening between the panel 14 and the caulked joint 15 to gain entry and thereafter when the blade is in the position shown in FIG. 3, a force can be applied to the handle and the bottom beveled edge can be pulled against the caulk and beading along the side of the panelled edge with the flat face of the blade 24 bearing against the panel edge and with the beveled edge of the blade working like a snowplow to free the caulk and bending from its binding contact with the opposed panel edge. In FIGS. 4 and 5, the tool is shown in such a way that first one edge is used to free one side of the bead 12 and then an opposite edge of the blade 24 is rotated and used to free the opposite side of the bead 12.

All caulking and sealing shall be performed when temperatures are above 40° F. in order to avoid application to moisture laden surfaces. Sealant should be tooled immediately to assure maximum adhesion and net joint appearance. It will be appreciated that when the cuff 37 is formed on the handle that it serves to protect the end of the handle in adjacency to the blade 24 so as to provide a tough exterior to the handle 16 to lengthen the life of the tool. Also, to positively locate the cuff 37 on the handle, the four circumferentially spaced holes 35 are filled with epoxy. These epoxy filled circumferentially spaced radially inwardly extending holes 35 (FIG. 10) co-act with the cuff 37 to inhibit axial and circumferential movement of the cuff 37 relative to the handle 16.

Shown in FIGS. 12–19 are several modifications of my invention. In FIG. 12, the caulk beading removal tool 38 is constructed similar to the tool 10 except that it has a different blade mounting bracket 39. This bracket 39 is of a U-shaped construction and has a base bracket leg 40. Connected to the base bracket leg 40 are a pair of spaced parallel extending bracket legs 41 and 42. Attachable with the bracket legs 41 and 42 are a pair of relatively flat, parallel edged tool steel cutting blades 47—47 which are similar to the cutting blade 24 except that the hole placements are slightly different. The holes are indicated at 44 in FIG. 13.

In order to mount the blades 43 on the bracket legs 41 and 42 suitable fasteners including bolts 45 and nuts 46 are applied. These bolts project through the holes 44 and secure the blades to the bracket legs in the same manner previously described in connection with the tool 10. In order to secure the bracket 39 to the handle 16, a fastener 47 is provided. The fastener 47 is similar to the fastener 21 shown in FIG. 11.

Figure 16:
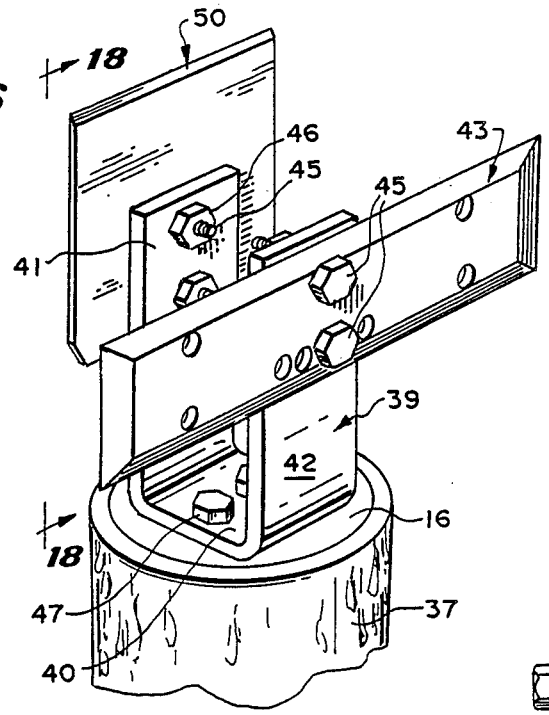
FIG. 16 is an enlarged fragmentary perspective view of the tool shown in FIG. 12 only with a pair of blades mounted differently than illustrated in FIGS. 13–15 inclusive.
Figure 18:
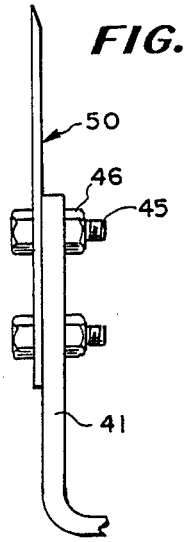
FIG. 18 is an enlarged fragmentary edge view taken on the line 18—18 looking in the direction indicated by the arrows as seen in FIG. 16.
Figure 17:
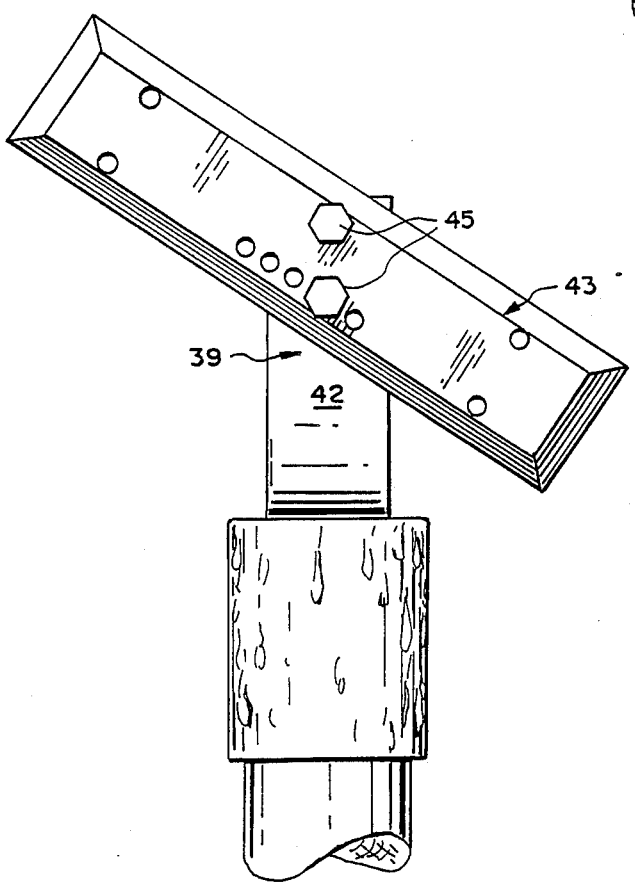
FIG. 17 is an enlarged fragmentary side view of the tool shown in FIG. 12 only with the blade mounted in an inclined position.

Now shown in FIGS. 16, 18 and 19 is still another modified type of blade indicated generally at 50. This blade is a so called "thin blade" which has a relatively thin dimension and is particularly suitable for removing hardened caulk in thin slots between building walls or tile surface. This thin blade 50 can also be provided with saw teeth at opposite edges as indicated at 51—51 in FIG. 19.

Through further study and investigation on my part, I have found that particular advantage can be obtained by utilizing a modified type of blade such as the one indicated at 50 in FIGS. 16, 18 and 19 which blade has been previously identified as a so-called "thin blade" where the thin blade is manufactured from spring steel and has a relatively dimension of the order of 0.025". The reason that the spring steel blade is particularly advantageous is that where the tool is to be used to remove caulk in thin joints, it is easier to work the tool in the slot to remove the caulk with a thin blade rather than a thicker blade. I have now found that spring steel is a more suitable material for manufacture of so-called "thin blades" than tool steel. My study has further indicated that hardened tool steel manufactured of a thickness of 0.025" tends to be too brittle and tends to shatter when used for this application.

I claim:

1. A caulk bead removal tool for removing caulk and beading from a groove between spaced side-by-side concrete building panels comprising a handle, a U-shaped mounting bracket at one end of the handle, means securing a center bracket leg of the bracket to one end of the handle, the bracket having a pair of parallel bracket legs extending from opposite ends of said center bracket leg in a longitudinal direction along a longitudinal axis of the handle but away from the handle, a pair of relatively flat tool steel cutting blades, means securing said blades to said parallel bracket legs, each of said blades having four bevel cut edges, and four right angle corners where said bevel cut edges meet, the four bevel cut edges being arranged in two sets with the edges in each set being disposed in parallel relation, the blades having their bevel cut sides mounted on the parallel bracket legs in such a way that one of said blades has its bevel cut side secured in face to face relation to the associated bracket leg and with another of said blades having its flat back side secured in abutment with an outside face of the associated parallel bracket leg.

2. The tool of claim 1 further characterized by each blade being mounted at opposite sides of the center bracket leg on parallel bracket legs.

3. The tool of claim 1 further characterized by said handle being comprised of a hard wood, said tool having a protective fiber glass epoxy cuff affixed to the wooden handle at the end where said mounting bracket is attached.

4. The tool of claim 3 further characterized by means for preventing the cuff from moving axially and circumferentially relative to the handle to inhibit relative movement there between comprising epoxy plugs embedded into the handle at circumferentially spaced intervals in the handle.

5. The tool of claim 1 further characterized by said means securing said blades to said parallel bracket legs in such a way as to position the blades at right angles to the bracket legs, and with the blades being positioned in spaced apart relation to enable the blades to work independently of one another.

6. The tool of claim 1 further characterized by said means securing said blades to said parallel bracket legs in such a way as to position the blades in angular relation to the bracket legs, and with the blades being positioned in spaced apart angled relation.

7. The tool of claim 1 further characterized by said means securing said blades to said brackets in spaced apart relation, and with the means being attached to the blades at adjacent ends of the blades leaving the blades extending away from the handle in directions away from opposite sides of the handle.

8. The tool of claim 1 further characterized by said blades being positioned in parallel relation and with the bevelled edges on one blade being disposed in parallel relation to the bevelled edges on the other blade enabling the tool to be flipped over after the edges on blade free a joint so the edges on the other blade can free the joint on its other side.

9. The tool of claim 1 further characterized by the blades having different sizes with one blade being longer and narrower than the other blade, the longer blade having its opposite ends extending beyond side edges of the other blade.

10. A caulk bead removal tool for removing caulk and beading from a groove between spaced side-by-side concrete building panels comprising a handle, an angle shaped mounting bracket at one end of the handle, means securing one leg of the mounting bracket to the handle, a second bracket leg extending axially away from said one leg in a direction generally along a horizontal axis of the handle, a relatively flat, parallel edged tool steel cutting blade, the blade having four beveled cut edges, the four bevel cut edges being arranged in two sets with the sets being at right angles to one another, blade attachment means for attaching the cutting blade to said second bracket leg, and spaced mounting holes in the blade for cooperation with said attachment means.

11. The tool of claim 10 further characterized by the bevel cut side of said cutting edges being disposed on a side of the blade that is abutted against said second bracket leg and held in assembly therewith by said blade attachment means.

12. The tool of claim 10 further characterized by each blade being mounted at opposite sides of the center bracket leg on parallel bracket legs.

13. A caulk bead removal tool for removing caulk and beading from a groove between spaced side-by-side concrete building panels comprising a handle, and a mounting bracket at one end of the handle, means securing one leg of the mounting bracket to the handle, a second bracket leg extending axially away from said one leg in a direction generally along a horizontal axis of the handle, a relatively flat, parallel edged tool steel cutting blade, the blade having four beveled cut edges, the four bevel cut edges being arranged in two sets with the sets being at right angles to one another, blade attachment means for attaching the cutting blade to said second bracket leg, and spaced mounting holes in the blade for cooperation with said attachment means, said handle being comprised of a hardwood, said tool having a protective fiberglass epoxy cuff affixed to the wooden handle at the end where said mounting bracket is attached.

14. The tool of claim 13 further characterized by means of preventing the cuff from moving axially and circumferentially relative to the handle to inhibit relative movement there between.

15. The tool of claim 10 further characterized by said means securing said blades to said parallel bracket legs in such a way as to position the blades at right angles to the bracket legs, and with the blades being positioned in space apart relation to enable the blades to work independently of one another.

16. The tool of claim 10 further characterized by said means securing said blades to said parallel bracket legs in such a way as to position the blades in inclined angular relation to the bracket legs, the blades having accurate slots permiting the blades to be secured to the bracket legs in inclined angular relations and with the blades being positioned in spaced apart angled relation.

17. The tool of claim 13 further characterized by said means securing one leg of the mounting bracket to the handle comprising a threaded screw embedded in the hardwood of said handle and with said protective fiberglass epoxy cuff protectively encasing the handle radially outwardly of where said screw is embedded in the wooden handle protecting the handle.

18. The tool of claim 13 further characterized by said blade attachment meas including a pair of superimposed fasteners, each fastener being comprised of a threaded bolt and a nut secured thereto, the blade having an upper opening receiving one of said fasteners in assembly therewith, the blade further having a lower arcuate opening for receiving another of said fasteners, the position of the blade being adjustably mounted relative to said second bracket leg permitting the blade to be permitted at a variety of angles relative to said second bracket leg.

19. The tool of claim 13 further characterized by said means securing one leg of the mounting bracket to the handle comprising a pair of threaded screws embedded in the hardwood of said handle and with said protective fiberglass epoxy cuff protectively encasing the handle radially outwardly of where said screws are embedded in the wooden handle protecting the handle.

20. A caulk bead removal tool for removing caulk and beading from a groove between spaced side-by-side concrete building panels comprising a handle, and a mounting bracket at one end f the handle, means securing one leg of the mounting bracket to the handle, a second bracket leg extending axially away from said one leg in a direction generally along a horizontal axis of the handle, relatively flat, parallel edged spring steel cutting blade, the spring steel cutting blade having a thickness of 0.025" for enabling the blade to readily penetrate and work in a groove between spaced side-by-side concrete building panels, the blade having four beveled cut edges, the four bevel cut edges being arranged in two sets with the sets being at right angles to one another, blade attachment means for attaching the cutting blade to said second bracket leg, and spaced mounting holes in the blade for cooperation with said attachment means, said handle being comprised of a hardwood, said tool having means affixed to the wooden handle at the end where said mounting bracket is attached to protectively encase the handle and to prolong life of the tool.

* * * * *